US010836537B2

(12) United States Patent
Whetsel et al.

(10) Patent No.: US 10,836,537 B2
(45) Date of Patent: Nov. 17, 2020

(54) MULTISENSORY EXAMINATION JAR FOR BOTANICAL SPECIMENS

(71) Applicants: Sam Whetsel, Denver, CO (US); Daniel Einhorn, Charleston, SC (US)

(72) Inventors: Sam Whetsel, Denver, CO (US); Daniel Einhorn, Charleston, SC (US)

( * ) Notice: Subject to any disclaimer, the term of this patent is extended or adjusted under 35 U.S.C. 154(b) by 228 days.

(21) Appl. No.: 15/910,682

(22) Filed: Mar. 2, 2018

(65) Prior Publication Data

US 2018/0362215 A1 Dec. 20, 2018

Related U.S. Application Data

(63) Continuation of application No. 29/607,785, filed on Jun. 16, 2017, now Pat. No. Des. 839,476.

(51) Int. Cl.
*B65D 25/54* (2006.01)
*B65D 51/24* (2006.01)
(Continued)

(52) U.S. Cl.
CPC ..... *B65D 25/54* (2013.01); *B65D 51/1683* (2013.01); *B65D 51/248* (2013.01);
(Continued)

(58) Field of Classification Search
CPC ... A01G 1/04; A01G 5/00; A01G 9/02; A01G 9/16; A01G 9/24; A01G 9/26;
(Continued)

(56) References Cited

U.S. PATENT DOCUMENTS 4,285,164 A * 8/1981 Moore ..... A01G 27/06 47/69
D289,143 S 4/1987 Guillaume
(Continued)

FOREIGN PATENT DOCUMENTS

CN 205821357 U * 12/2016
CN 206212767 U * 6/2017
(Continued)

OTHER PUBLICATIONS

Stash Jar. 2 pages. Viewed online Jul. 25, 2018 at https://www.smokusfocus.com/shop/stash-jar/. SmokusFocus, Denver, CO.

*Primary Examiner* — Bryon P Gehman
(74) *Attorney, Agent, or Firm* — Gregory Finch; Finch Paolino, LLC

(57) ABSTRACT

Embodiments of the present disclosure provide for a multisensory examination jar for botanical specimens. Embodiments of the disclosed jar may have a body portion with an integrated LED array for illuminating the contents of the jar. The jar may have a removable lid with an integrated magnifying lens, and an opening or port to enable a user to smell the contents of the jar. The opening may have a removable plug to establish a substantially air tight seal on the lid of the jar, to trap odors within the jar. The removable plug can be selectively removed to enable the user to smell the contents of the jar. The jar may have an electronics module and power source operable for wireless charging. The jar may also be configured to interface with a charging dock or base for wireless charging of integrated batteries.

18 Claims, 6 Drawing Sheets

(51) Int. Cl.
*B65D 85/50* (2006.01)
*B65D 51/16* (2006.01)

(52) U.S. Cl.
CPC ..... *B65D 85/50* (2013.01); *B65D 2201/00* (2013.01); *B65D 2203/12* (2013.01); *B65D 2205/00* (2013.01)

(58) Field of Classification Search
CPC .... B65D 25/24; B65D 51/16; B65D 51/1683; B65D 51/24; B65D 51/248; B65D 85/50; B65D 2001/00; B65D 2203/12; B65D 2205/00; C12M 3/00
USPC ..... 206/423; 359/804
See application file for complete search history.

(56) References Cited

U.S. PATENT DOCUMENTS 4,979,332 A * 12/1990 Nagaya ..... A01G 9/02 47/69
D323,674 S 2/1992 Winslow
D364,093 S 11/1995 Weaver, Jr.
D551,983 S 10/2007 Barbagli
D570,648 S 6/2008 Bodum
D607,340 S 1/2010 Klis
7,644,536 B2 * 1/2010 Farhadi ..... A01G 9/16 47/1.01 R
D645,750 S 9/2011 Lee
8,166,701 B1 * 5/2012 Duff, Sr. ..... A47G 7/041 47/39
D716,099 S 10/2014 Farber et al.
D737,503 S 8/2015 Now
9,334,086 B2 * 5/2016 Bean ..... B65D 25/54
9,630,747 B2 4/2017 Smith et al.
D786,082 S 5/2017 Kachar et al.
D803,287 S 11/2017 Whetsel et al.
D804,093 S 11/2017 Chen
D814,105 S 3/2018 Eng et al.
10,384,834 B2 8/2019 Smith et al.
2004/0211746 A1 10/2004 Trude
2008/0308559 A1 12/2008 Peleg
2014/0069007 A1 * 3/2014 Chen ..... A01G 7/045 47/66.6
2015/0191279 A1 7/2015 Price
2015/0298136 A1 10/2015 Dukat
2015/0313095 A1 * 11/2015 Fenner, Jr. ..... A01G 9/02 47/84
2016/0128513 A1 5/2016 Chan
2017/0275053 A1 * 9/2017 Wartersian ..... B65D 25/54
2018/0242529 A1 * 8/2018 Tian ..... A47G 7/06

FOREIGN PATENT DOCUMENTS

CN 206273085 U * 6/2017
CN 206596415 U * 10/2017
CN 206776505 U * 12/2017

* cited by examiner

MULTISENSORY EXAMINATION JAR FOR BOTANICAL SPECIMENS

CROSS REFERENCE TO RELATED APPLICATIONS

This application is a continuation of U.S. Design patent application Ser. No. 29/607,785, filed on Jun. 16, 2017 entitled "LIGHTED MAGNIFIED DISPLAY JAR," the disclosure of which is hereby incorporated in its entirety at least by reference.

FIELD

The present disclosure relates to the field of botanical examination and observation; in particular, a lighted magnified display jar with sealable smell port for multisensory examination of botanical specimens.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a multisensory examination jar apparatus comprising a lid having side walls defining a circumference and a top portion extending from the side walls, the top portion comprising a circular aperture and an elongated aperture, the circular aperture having side walls defining a viewing portion and the elongated aperture having side walls defining a smell port, the lid having a magnifying lens coupled to an interior portion in alignment with the circular aperture; a smell port plug removably coupled to the elongated aperture, the smell port plug having a bottom portion and side walls, the smell port plug being configured to seal the smell port when removably coupled to the elongated aperture; a housing being selectively coupled to the lid, the housing having an upper circumference and a lower circumference with a support structure extending therebetween to define a viewing area, the housing having a jar portion defining an interior portion of the housing; an LED array disposed around an interior portion of the upper circumference of the housing; and, an electronics module being operably engaged with the LED array and a power source.

Another object of the present disclosure is a magnified display jar apparatus comprising a lid having side walls defining a circumference and a top portion extending from the side walls, the top portion having a circular aperture and an elongated aperture, the circular aperture having side walls defining a viewing portion and the elongated aperture having side walls defining an odor port, and a magnifying lens coupled to an interior portion of the lid in alignment with the circular aperture; an odor plug removably coupled to the elongated aperture, the odor plug having a bottom and side walls configured to seal the odor port when removably coupled to the elongated aperture; a housing being selectively coupled to the lid, the housing having an upper circumference and a lower circumference with a support structure extending therebetween to define a viewing area, the housing having a jar portion defining an interior portion of the housing, the upper circumference of the housing having a channel portion disposed around an interior portion of the upper circumference; an LED array comprising a plurality of LEDs being mounted on a ring-shaped array surface, the LED array being coupled to the channel portion of the upper circumference of the housing; and, an electronics module being operably engaged with the LED array and a power source.

Yet another object of the present disclosure is a magnified display jar apparatus comprising a lid having side walls defining a circumference and a top portion extending from the side walls, the top portion having a circular aperture and an elongated aperture, the circular aperture having side walls defining a viewing portion and the elongated aperture having side walls defining an odor port, and a magnifying lens coupled to an interior portion of the lid in alignment with the circular aperture; an odor plug removably coupled to the elongated aperture, the odor plug having a bottom and side walls configured to seal the odor port when removably coupled to the elongated aperture; a housing being selectively coupled to the lid, the housing having an upper circumference and a lower circumference with a support structure extending therebetween to define a viewing area, the housing having a jar portion defining an interior portion of the housing, the upper circumference of the housing having a channel portion disposed around an interior portion of the upper circumference; an LED array comprising a plurality of LEDs being mounted on a ring-shaped array surface, the LED array being coupled to the channel portion of the upper circumference of the housing; and, an electronics module being operably engaged with the LED array and a power source.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
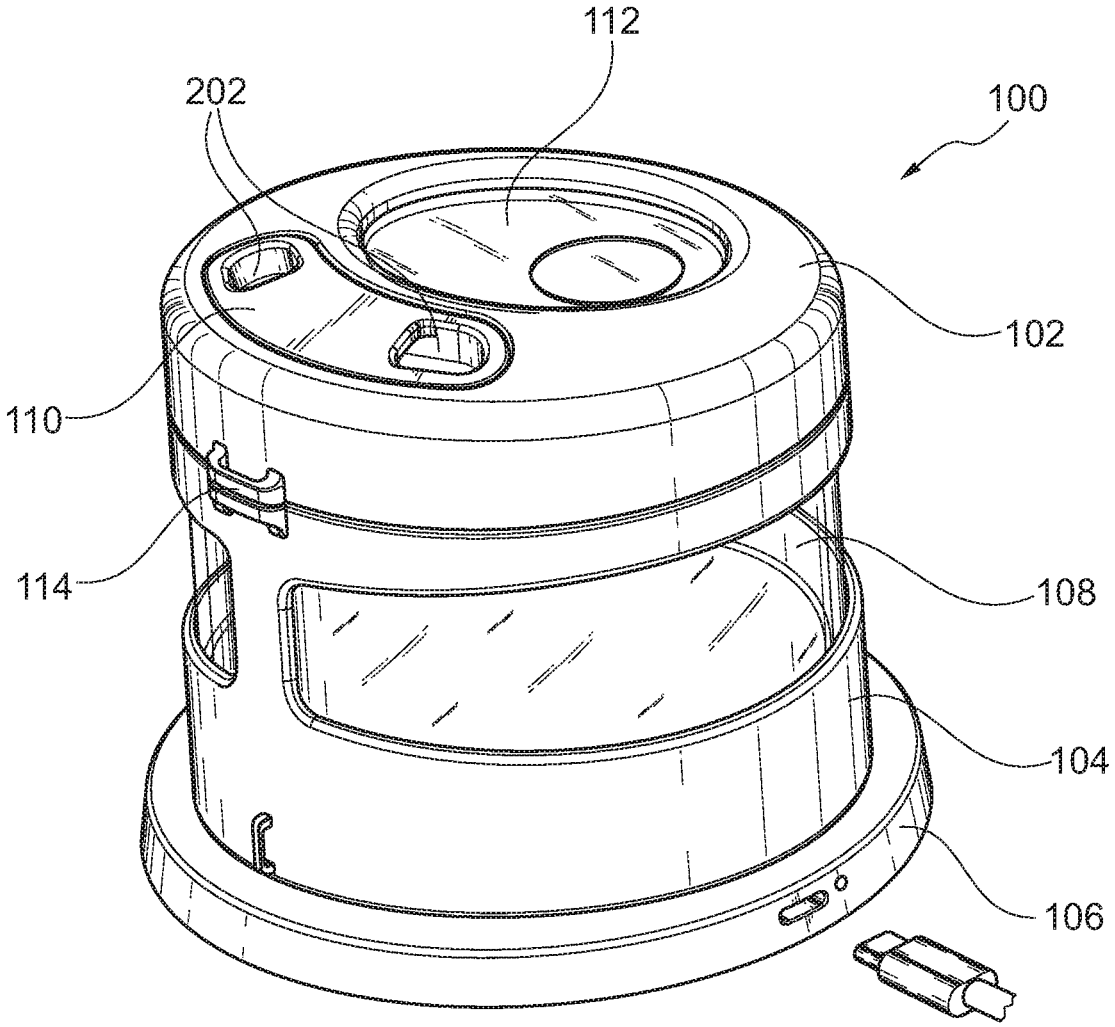
FIG. 1 is an isometric view of a magnified lighted display jar with sealable smell port, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide for a multisensory examination jar for botanical specimens; more particularly, a magnified lighted display jar for displaying, viewing, and smelling flowers and other vegetation. Embodiments of the disclosed jar may have a body portion with an integrated LED array for illuminating the contents of the jar. The jar may have a removable lid with an integrated magnifying lens, and an opening or port to enable a user to smell the contents of the jar. The opening may have a removable plug to establish a substantially air tight seal on the lid of the jar, to trap odors within the jar. The removable plug can be selectively removed to enable the user to smell the contents of the jar. The jar may have an electronics module and power source operable for wireless charging. The jar may also be configured to interface with a charging dock or base for wireless charging of integrated batteries.

Referring now to FIG. 1, an isometric view of a magnified display jar with sealable smell port 100 is shown. According to an embodiment of the present disclosure, magnified display jar 100 is configured to store flowers, or other items, in a jar portion 108. Jar portion 108 is housed in housing 104. A lid portion 102 interfaces with body portion 108 to contain and seal the contents of jar portion 108. Lid portion 102 contains a magnifying lens 112 and a smell or odor port plug 110. Smell port plug 110 may be constructed from rubber, plastic, and the like. Smell port plug 110 may have a gripping portion 202 that enables a user to remove smell port plug 110 from lid 102. Lid 102 and housing 104 contain a security connector portion 114. Security connector portion 114 enables a user to securely couple lid 102 and housing 104 with a cable, zip tie, locking device, or other connection means to prevent lid 102 from being removed from housing 104. A charging dock 106 is operable to interface with a lower portion of housing 104 to enable wireless charging of an integrated battery pack.

Figure 2:
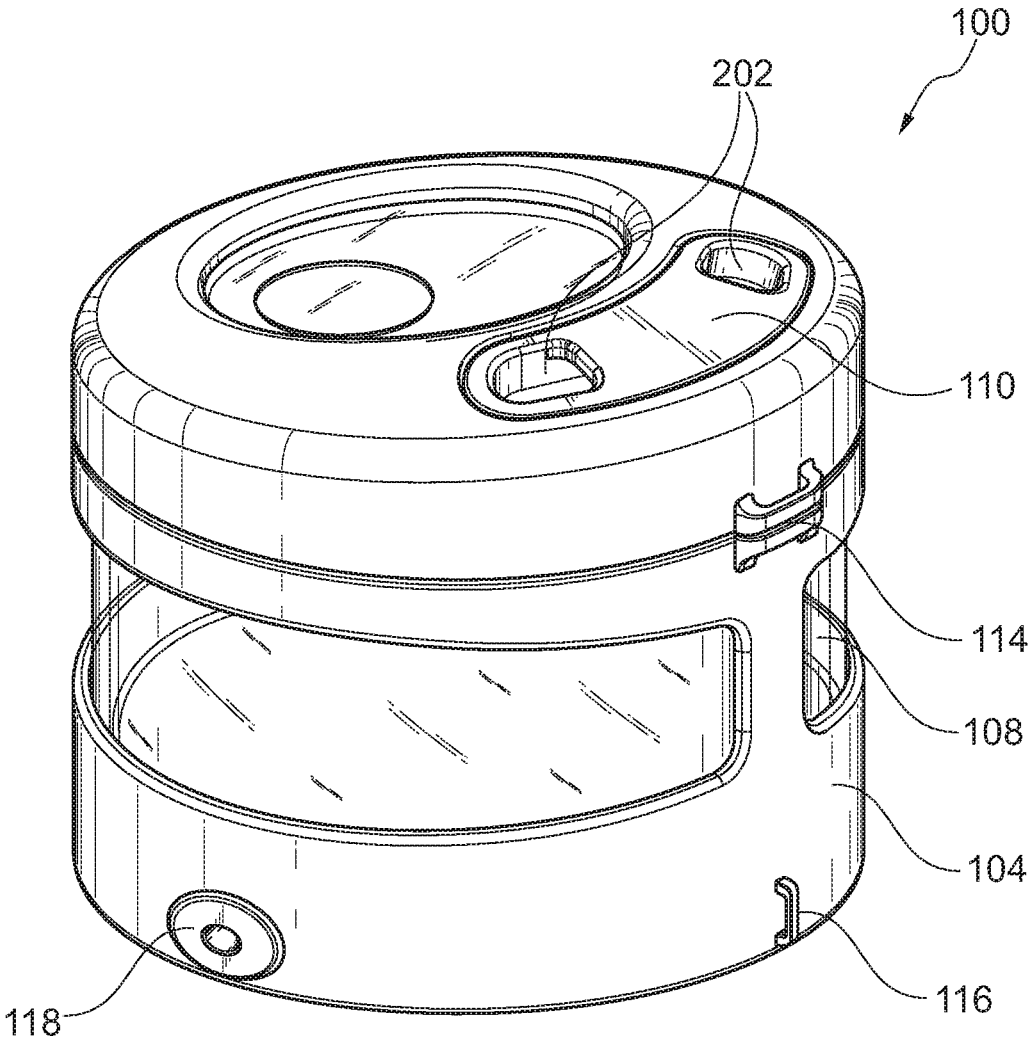
FIG. 2 is an isometric view of a magnified lighted display jar with sealable smell port, according to an embodiment of the present disclosure.

Referring now to FIG. 2, an isometric view of magnified display jar with sealable smell port 100 is shown. According to an embodiment of the present disclosure, magnified jar 100 contains an array of light-emitting diodes (LEDs) coupled to an upper interior portion of housing 104. A power button 118 is operably engaged with an integrated battery and is configured to turn the LED array on and off in relation to the integrated battery. Housing 104 may also have a lower security connector portion or eyelet 116, which is configured to receive a cable, zip tie, or the like for securely connecting or locking magnified display jar 100 to a desired location.

Figure 3:
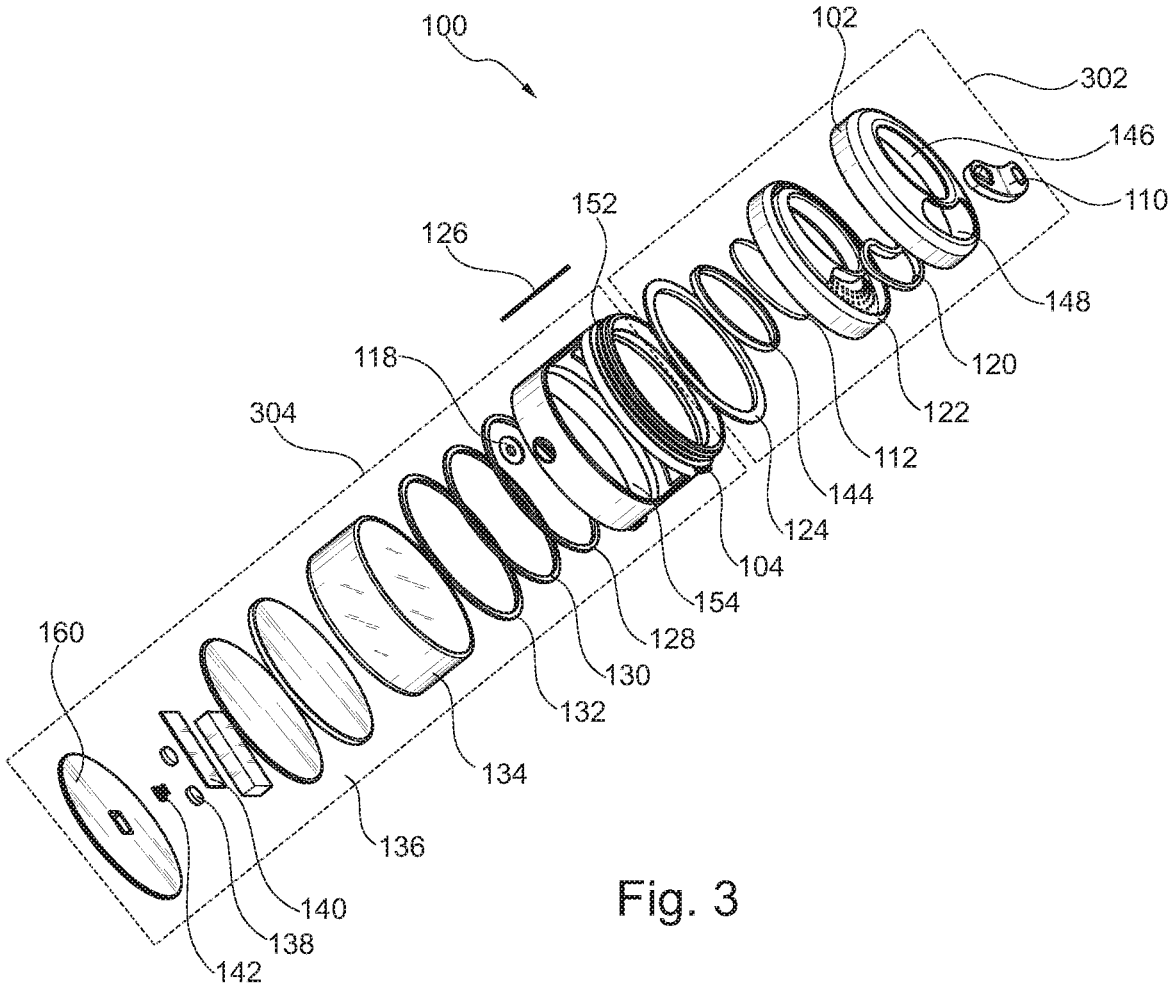
FIG. 3 is an exploded view of a magnified lighted display jar with sealable smell port, according to an embodiment of the present disclosure.

Referring now to FIG. 3, an exploded view of magnified display jar with sealable smell port 100 is shown. According to an embodiment of the present disclosure, magnified display jar 100 is generally comprised of a lid assembly 302, a body assembly 304, and an electronics assembly 306. Lid assembly 302 is generally comprised of lid 102, smell port plug 110, smell port gasket 120, lid insert 122, magnifying lens 112, lens coupling 144, and lid gasket 124. Lid 102 is comprised of a circular opening defining a viewing area 146 and an elongated opening defining a smell port 148. Smell port plug 110 is configured to be the same shape as smell port 148 such that smell port plug 110 may be mateably coupled with smell port 148. Lid insert 122 is configured to mateably couple with lid 102, such that lid insert 122 aligns with viewing area 146 and smell port 148. Lid insert 122 may further comprise a smelling surface 150. Smelling surface 150 is configured to extend between the area of smell port 148. Smelling surface 150 contains a plurality of apertures such that air (i.e. smell) may freely flow therethrough, but configured such that a user is prevented from inserting their fingers or a foreign object into the interior portion of magnified display jar 100. Smell port gasket 120 is inserted against a perimeter of smelling surface 150 and then lid insert 122 is mateably coupled with lid 102. Smell port gasket 120 provides a substantially air tight seal between lid insert 122 and lid 102 along the perimeter of smell port 148. Lens 112 is coupled to an interior portion of lid insert 122 in alignment with viewing area 146. Lens coupling 144 is configured to secure lens 112 to lens insert 122 in alignment with viewing area 146. Lens coupling 144 may be screwed, glued, or otherwise coupled to lens insert 122 in order to secure lens 112. Lid gasket 124 may be coupled to and disposed around a perimeter of lid insert 112 such that lid assembly 302 may establish a substantially airtight seal with body assembly 304 when coupled to body 104. Lid insert 122 and body 104 may have complementary threaded portions such that lid assembly 302 may be screwed and unscrewed from body assembly 304. The threaded portions of lid insert 122 and body 104 should be configured such that security connectors 114 (as shown in FIG. 1) are aligned when lid assembly 302 is coupled to body assembly 304. The threaded portions of lid insert 122 and body 104 are a design choice to provide stability and a more air tight connection, but lid assembly 302 and body assembly 304 may be mateably coupled using any suitable mechanical means.

Figure 5:
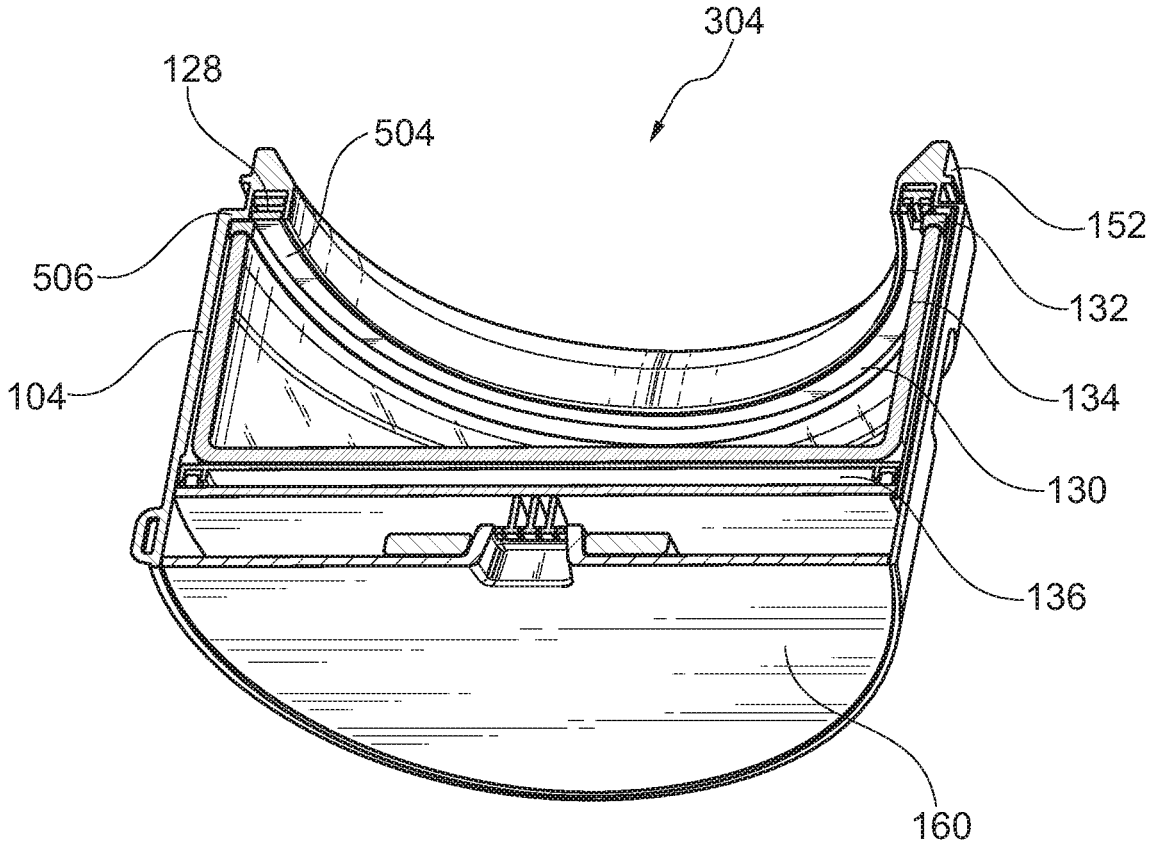
FIG. 5 is a cross sectional view of a magnified lighted display jar with sealable smell port, according to an embodiment of the present disclosure; and, FIG. 6 is an isometric view of a magnified lighted display jar with sealable smell port with the lid in an open configuration, according to an embodiment of the present disclosure.

Body assembly 304 is generally comprised of housing 104, LED array 128, LED gasket 130, jar gasket 132, jar 134, power switch 118, electronics housing 136, circuitry 140, batteries 138, power connector 142, and base portion 160, and bus 126. Housing 104 may be comprised of an upper circumference 152, a lower circumference 156, and a support structure 158 extending between upper circumference 152 and lower circumference 156 to provide structural integrity of housing 104 and to define a viewing area 154 extending between an upper perimeter of lower circumference 156 and a lower perimeter of upper circumference 152. LED array 128 comprises a plurality of LEDs disposed around LED array 128 (as shown in FIG. 5). LED array 130 is coupled to a channel portion (as shown in FIG. 5) of housing 104. LED gasket 130 is disposed on LED array 130 to secure and conceal LED array 130 in the channel portion (as shown in FIG. 5) of housing 104. Jar gasket 132 is disposed around an inner perimeter of housing 104 adjacent to the channel portion (as shown in FIG. 5) of housing 104. Jar 104 is housed in an interior portion of housing 104. Jar gasket 132 provides an interface between jar 134 and housing 104 to ensure a secure fit between jar 134 and housing 104.

Electronics housing 136 couples to base portion 160 to contain circuitry 140, batteries 138, power connector 142. Power connector 142 interfaces with a power connector aperture in base 160 such that power connector 142 can interface with the charging dock (as shown in FIG. 1). Electronics housing 136 interfaces with a lower portion of housing 104 to securely couple jar 134 in the interior portion of housing 104. Bus 126 provides power transfer between LED array 128 and batteries 138. Power switch 118 is operably engaged with circuitry 140 to control the transfer of power from batteries 138 to LED array 128 via bus 126.

Figure 4:
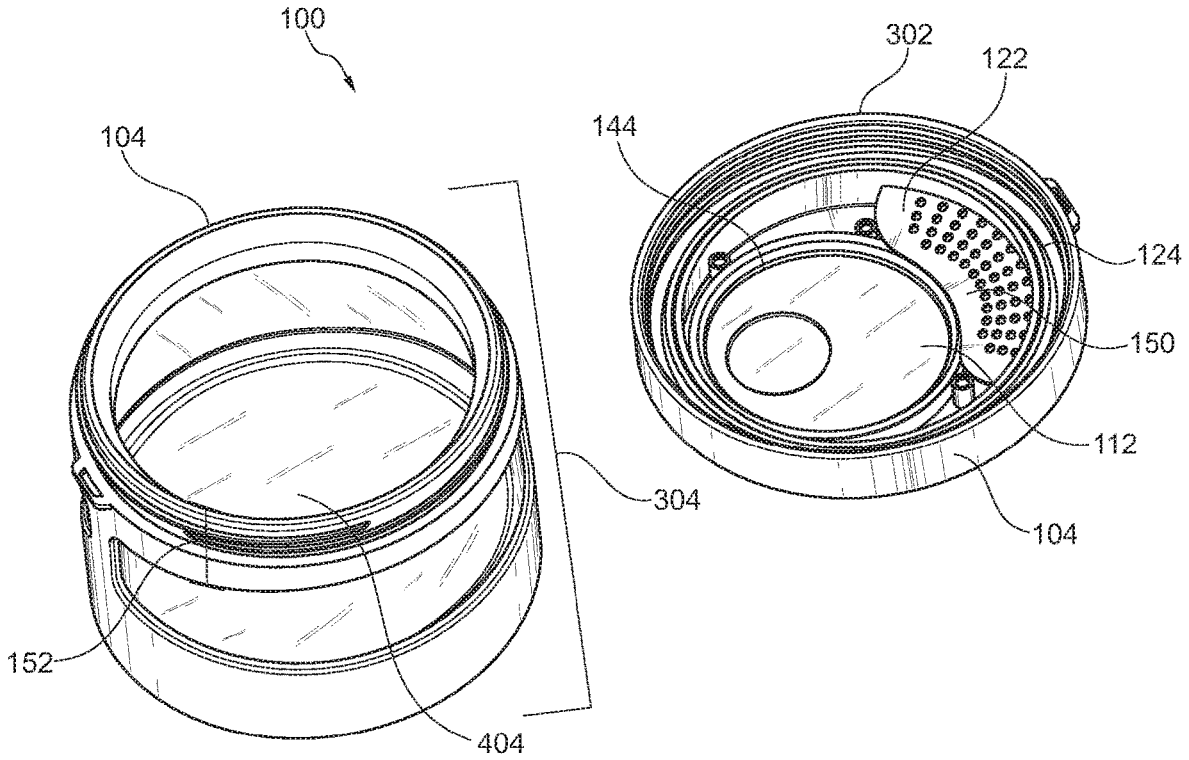
FIG. 4 is an isometric view of a magnified lighted display jar with sealable smell port, according to an embodiment of the present disclosure.

Referring now to FIG. 4, an isometric view of a magnified display jar with sealable smell port 100 is shown. According to an embodiment of the present disclosure, magnified display jar 100 is shown in an open configuration, with lid assembly 302 disconnected from housing 104. Lid gasket 124 is shown coupled to an inner portion of lid insert 122. Lens coupling 144 is shown being screwed to lid insert 122 to secure lens 112. The threaded portions of lid insert 122 and housing 104, as discussed in FIG. 3 above, are shown. The user places a desired item, such as a flower, into the interior portion 402 of body assembly 304 and secures lid assembly 302 to body assembly 304 to securely contain the item for viewing and examination via lens 112 and smell port 148 (as shown in FIG. 3).

Referring now to FIG. 5, a cross-sectional view of body assembly 304 is shown. According to an embodiment of the present disclosure, upper circumference 152 of housing 104 is comprised of channel 502 and an inner perimeter 506. LED array 128 is housed in channel 152 and LED gasket 130 is disposed on LED array 128. LED array 128 has a plurality of LEDs 504 disposed thereon. In an embodiment, LED array 128 has between four and eight LEDs 504 disposed equidistant around the circumference of LED array 128. LED gasket 130 has a plurality of apertures disposed equidistant around the circumference of LED gasket 130 in alignment with the location of LEDs 504 disposed LED array 128. Jar gasket 132 is disposed around inner perimeter 506 to secure jar 134 inside housing 104. Inner perimeter 506 is offset from channel 502 such that LEDs 504 disposed LED array 128 are not impeded by jar gasket 132 and/or jar 134.

Figure 6:
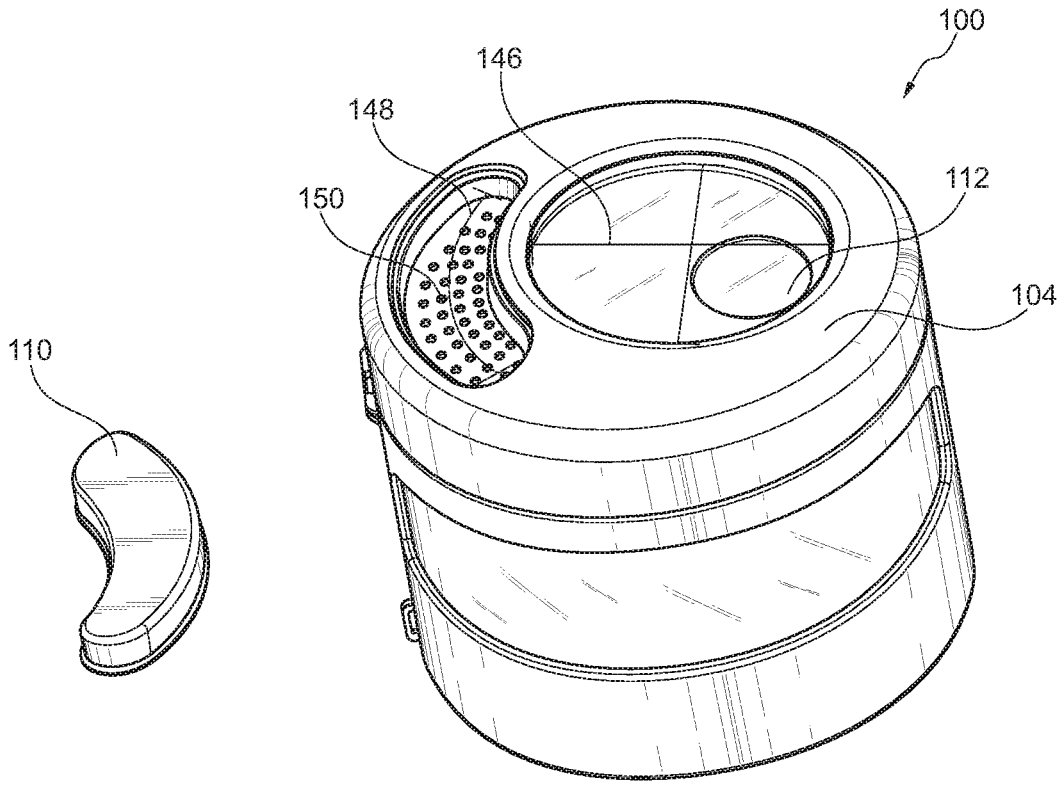

Referring now to FIG. 6, an isometric view of a magnified display jar 100 with smell port plug 110 removed is shown. According to an embodiment of the present disclosure, magnified lighted display jar 100 is configured such that a user can visually examine and smell the contents of magnified display jar 100 simultaneously. With smell port plug 110 removed, the user may bring magnified display jar 100 adjacent to his or her face such that the user's nose is approximately centered horizontally with smell port 148. The user may then align viewing area 146 adjacent to the user's eyes, such that the user may visually examine the contents of magnified display jar 100 via lens 112, while simultaneously smell the contents of magnified display jar 100 via smell port 148. According to an embodiment, viewing area 146 is circular in shape and is off-centered in relation to the center of lid 102 (in relation to the circumference of lid 102). Smell port 148 may be elongated in shape and configured as an arc in relation to the circumference of lid 102. Smell port 148 may have an arc angle in the range of about 30 degrees to about 90 degrees, although any shape or configuration suitable to enable simultaneous viewing and smelling via lid 102 is anticipated. When the user has concluded examining the contents of magnified lighted display jar 100 the user replaces smell port plug 110, thereby establishing a substantially air tight seal on lid 102.

Embodiments of the present disclosure provide for a multisensory examination jar for botanical specimens. The multisensory examination jar as described herein provides the following, non-exhaustive, improvements over the prior art:

Simultaneous visual and olfactory examination of botanical specimens;

Integration of full spectrum lighting, magnification lens, and olfactory examination port;

Integration of a circular LED array to prevent unobstructed illumination of the botanical specimen, regardless of the placement or configuration of the lid;

Wireless charging of integrated batteries via a removable charging dock;

Multiple security attachments for ensuring the integrity of the contained specimen, and well as physical security of the multisensory examination jar;

Unique design of lid to support optimal placement of visual and olfactory examination areas.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A multisensory examination jar apparatus comprising:

a lid having side walls defining a circumference and a top portion extending from the side walls, the top portion comprising a circular aperture and an elongated aperture, the circular aperture having side walls defining a viewing portion and the elongated aperture having side walls defining a smell port, the lid having a magnifying lens coupled to an interior portion in alignment with the circular aperture;

a lid insert portion coupled to the interior portion of the lid, the lid insert portion comprising a surface portion extending across the smell port, wherein the surface portion comprises a plurality of apertures;

a smell port plug removably coupled to the elongated aperture, the smell port plug having a bottom portion and side walls, the smell port plug being configured to seal the smell port when removably coupled to the elongated aperture;

a housing being selectively coupled to the lid, the housing having an upper circumference and a lower circumference with a support structure extending therebetween to define a viewing area, the housing having a jar portion defining an interior portion of the housing;

an LED array disposed around an interior portion of the upper circumference of the housing; and an electronics module being operably engaged with the LED array and a power source.

2. The multisensory examination jar apparatus of claim 1 further comprising an inductive charging dock being selectively engaged with the power source.

3. The multisensory examination jar apparatus of claim 1 further comprising a security connector portion disposed on a lower surface of the lid and an upper surface of the housing.

4. The multisensory examination jar apparatus of claim 1 wherein the lid insert portion is configured to selectively couple the lid to the upper circumference of the housing.

5. The multisensory examination jar apparatus of claim 1 wherein the lid is configured such that the viewing portion and the smell port are substantially aligned such that a user can simultaneously view and smell an item being housed in the interior portion of the housing.

6. The multisensory examination jar apparatus of claim 1 wherein the smell port plug further comprises a gripping portion.

7. The multisensory examination jar apparatus of claim 1 wherein the smell port plug is configured such that, when removably coupled to the elongated aperture, the bottom portion of the smell port plug sits flush with the surface portion of the lid insert portion and the side walls of the smell port plug are flush with the side walls of the smell port.

8. The multisensory examination jar apparatus of claim 1 wherein the lens is coupled to the lid insert portion.

9. A multisensory examination jar apparatus comprising:

a lid having side walls defining a circumference and a top portion extending from the side walls, the top portion having a circular aperture and an elongated aperture, the circular aperture having side walls defining a viewing portion and the elongated aperture having side walls defining a smell port, and a magnifying lens coupled to an interior portion of the lid in alignment with the circular aperture;

a smell port plug removably coupled to the elongated aperture, the smell port plug having a bottom and side walls configured to seal the smell port when removably coupled to the elongated aperture;

a housing being selectively coupled to the lid, the housing having an upper circumference and a lower circumference with a support structure extending therebetween to define a viewing area, the housing having a jar portion defining an interior portion of the housing, the upper circumference of the housing having a channel portion disposed around an interior portion of the upper circumference;

an LED array comprising a plurality of LEDs being mounted on a ring-shaped array surface, the LED array being coupled to the channel portion of the upper circumference of the housing;

an electronics module being operably engaged with the LED array and a power source; and a LED gasket being disposed on the LED array and coupled to the channel portion of the upper circumference of the housing, the LED gasket comprising a plurality of apertures configured to align with the plurality of LEDs mounted on the ring-shaped array surface.

10. The multisensory examination jar apparatus of claim 9 further comprising a security connector portion disposed on a lower surface of the lid and an upper surface of the housing.

11. The multisensory examination jar apparatus of claim 9 further comprising a lid insert portion coupled to the interior portion of the lid, the lid insert portion comprising a surface portion extending across the smell port, wherein the surface portion comprises a plurality of apertures.

12. The multisensory examination jar apparatus of claim 11 wherein the smell port plug is configured such that, when removably coupled to the elongated aperture, the bottom portion of the smell port plug sits flush with the surface portion of the lid insert portion and the side walls of the smell port plug are flush with the side walls of the smell port.

13. The multisensory examination jar apparatus of claim 11 wherein the lid insert portion is configured to selectively couple the lid to the upper circumference of the housing.

14. The multisensory examination jar apparatus of claim 9 wherein the lid is configured such that the viewing portion and the smell port are substantially aligned such that a user can simultaneously view and smell an item being housed in the interior portion of the housing.

15. A multisensory examination jar apparatus comprising:

a lid having side walls defining a circumference and a top portion extending from the side walls, the top portion having a circular aperture and an elongated aperture, the circular aperture having side walls defining a viewing portion and the elongated aperture having side walls defining a smell port, and a magnifying lens coupled to an interior portion of the lid in alignment with the circular aperture;

a lid insert portion coupled to the interior portion of the lid, the lid insert portion having a surface portion extending across the smell port, the surface portion comprising a plurality of apertures;

a smell port plug removably coupled to the elongated aperture, the smell port plug having a bottom and side walls configured to seal the smell port when removably coupled to the elongated aperture, wherein the smell port plug is configured such that, when removably coupled to the elongated aperture, the bottom portion of the smell port plug sits flush with the surface portion of the lid insert portion and the side walls of the smell port plug are flush with the side walls of the smell port;

a housing being selectively coupled to the lid, the housing having an upper circumference and a lower circumference with a support structure extending therebetween to define a viewing area, the housing having a jar portion defining an interior portion of the housing, the upper circumference of the housing having a channel portion disposed around an interior portion of the upper circumference;

an LED array comprising a plurality of LEDs being mounted on a ring-shaped array surface, the LED array being coupled to the channel portion of the upper circumference of the housing; and an electronics module being operably engaged with the LED array and a power source.

16. The multisensory examination jar apparatus of claim 15 further comprising a security connector portion disposed on a lower surface of the lid and an upper surface of the housing.

17. The multisensory examination jar apparatus of claim 15 wherein the lid is configured such that the viewing area and the smell port are substantially aligned such that a user can simultaneously view and smell an item being housed in the interior portion of the housing.

18. The multisensory examination jar apparatus of claim 15 wherein the lid insert portion is configured to selectively couple the lid to the upper circumference of the housing.

* * * * *